United States Patent [19]

Caddick

[11] Patent Number: 4,831,751

[45] Date of Patent: May 23, 1989

[54] WATER CRAFT FOR CLEARING NAVIGATIONAL WATERS

[76] Inventor: Joseph Caddick, 74 Winifred Lane, Aughton, Ormskirk, Lancashire L39, 5DL, England

[21] Appl. No.: 123,708

[22] Filed: Nov. 23, 1987

[30] Foreign Application Priority Data

Apr. 7, 1987 [GB] United Kingdom ..... 8708259

[51] Int. Cl.[4] ..... E02F 5/28

[52] U.S. Cl. ..... 37/71

[58] Field of Search ..... 37/71, 54, 75, 76, 195

[56] References Cited

U.S. PATENT DOCUMENTS

| | | | |
|---|---|---|---|
| 575,272 | 1/1897 | Potter | 37/71 X |
| 2,606,375 | 8/1952 | Braun et al. | 37/75 |
| 2,640,284 | 6/1953 | Nielsen | 37/71 |
| 2,853,812 | 9/1958 | Van Riet et al. | 37/76 X |
| 2,952,083 | 9/1960 | Forkner | 37/71 |
| 3,486,253 | 12/1969 | Bruggeman | 37/54 |
| 4,676,052 | 6/1987 | Hawk | 37/54 X |

FOREIGN PATENT DOCUMENTS

| | | | |
|---|---|---|---|
| 995304 | 6/1965 | United Kingdom | 37/71 |

*Primary Examiner*—Clifford D. Crowder
*Attorney, Agent, or Firm*—William E. Mouzavires

[57] ABSTRACT

A water craft for clearing navigational waters comprises a floatable body (10) which is provided with propulsion in the form of a propeller (16) and steering in the form of a rudder (18). Two arms (28) are pivotally mounted in the central third portion of the craft, below the waterline of the craft when in use. A scoop (24) is pivotally mounted to the ends of the two arms (28), and may be pivoted by means of a hydraulic ram (42). The arms (28) are pivotable upwardly and downwardly by retraction and extension respectively of associated double-acting hydraulic rams (50).

16 Claims, 2 Drawing Sheets

WATER CRAFT FOR CLEARING NAVIGATIONAL WATERS

BACKGROUND OF INVENTION

The present invention relates to water craft for clearing navigational waters, and in particular, but not exclusively, to a water craft for clearing the beds of navigational waters, such as rivers, canals and docks.

Most water craft of this type are relatively small, such that they are highly maneuverable in places such as rivers, canals and docks, where there is often a limited amount of space in which to move, especially if the waterway is blocked with debris. A water craft for clearing navigational waters is described in U.S. Pat. Nos. 3,326,379, 3,434,444, 4,616,588, 4,674,984 and Des. 290,351. It comprises a floating body having propulsion means and steering means, and an arm pivotally mounted above the deck of the craft on the end of which arm is mounted a scoop for clearing flotsam from the surface of the water. The arm is pivotable by means of a hydraulic ram extending between the arm and a fixed portion on the craft, and the scoop may be tilted by a hydraulic ram mounted between the arm and a fixed portion on the craft, and the scoop may be tilted by a hydraulic ram mounted between a portion of the scoop and a portion of the arm.

Such a device has been successfully used for many years, but it is known that it suffers from certain disadvantages. One such disadvantage is that the craft is suitable only for removing material from the surface of the water, or slightly below the surface, since the depth to which the scoop can be lowered is somewhat limited. A second disadvantage is that when the scoop is fully loaded, the craft is rendered unstable in the water.

One device which is able to clear the beds of navigational waters comprises a floating body, such as a barge-type craft, which has a hydraulically-actuated arm mounted on its deck, the arm being provided with a scoop at its free end. The arm is movable such that the scoop can extend to the bed of a waterway, and can be used to remove debris therefrom. Unfortunately, as the scoop lifts the debris, the craft itself is moved across the surface of the waterway due to the equal and opposite reaction force. Thus, with such a craft it is not possible to position the craft accurately in the water, and removal of debris from the bed of the waterway is also hindered by the movement of the craft. In order to overcome this disadvantage, such craft are provided with a plurality of legs or "spuds", usually one at each corner of the craft, which may be lowered onto the bed of the waterway. In use, the craft moves to a desired position and the spuds are lowered onto the bed of the waterway, thereby securing the craft in a fixed position. The arm is then manoeuvred to remove as much debris as possible from the bed in the vicinity of craft, whereupon the spuds are retracted and the craft is moved on to an adjacent position where the spuds are once again lowered into contact with the bed, and the operation is repeated.

The above craft is obviously not very maneuverable in use, since it is necessary to lower the spuds each time debris is to be removed from the bed of the waterway. Lowering and retraction of the spuds also takes time, and may require an extra operator to lower and raise them, while a different operator controls the craft to keep it in a fixed position on the waterway.

OBJECTS OF THE INVENTION

It is an object of the present invention to provide a water craft and method which may be used to remove debris from the bed of a waterway, and which overcome the above-mentioned disadvantages.

Another object of the present invention is to provide a water craft and method of using the same to pick up debris from a waterway with the aid of the movement of the craft in the water and without rendering the craft unstable or other use adversely affecting the operation of the craft.

SUMMARY OF PREFERRED EMBODIMENT OF THE INVENTION

In accordance with a first aspect of the present invention, there is provided a water craft for clearing navigational waters, the water craft comprising a floatable body having propulsion means and steering means, at least one lifting arm pivotally mounted on the side of the floatable body, a scoop mounted on the arm in front of the bow, and actuating means for pivoting the arm downwardly to lower the scoop to a position below the level of the base of the floatable body, whereupon the movement of the water craft, induced by the propulsion means and guided by the steering means, causes the scoop to pick up debris, the arm also being pivotable upwardly to raise the scoop above the surface of the water for discharging the debris removed from the waterway.

In contrast to the prior art, the present invention encounters no problems with the stability of the craft when the scoop is picking up debris from a waterway, since it is essential that the craft be moving in order for the scoop to pick up debris from the waterway.

In a preferred embodiment, the craft comprises two lifting arms, mounted on the sides of the craft respectively, the free ends of the arms being pivotally connected to a single scoop for picking up debris.

Preferably, the arms are pivotable by means of one or more fluid-actuated rams extending between a point on the craft and a point on the associated arm. Preferably, a fluid-actuated ram is connected between the scoop and a portion of one or both of the arms such that the scoop is pivotable about the free end of the arms.

DRAWINGS

By way of example only, specific embodiments of the present invention will now be described, with reference to the accompanying drawings, in which.

DETAILED DESCRIPTION

Figure 1:
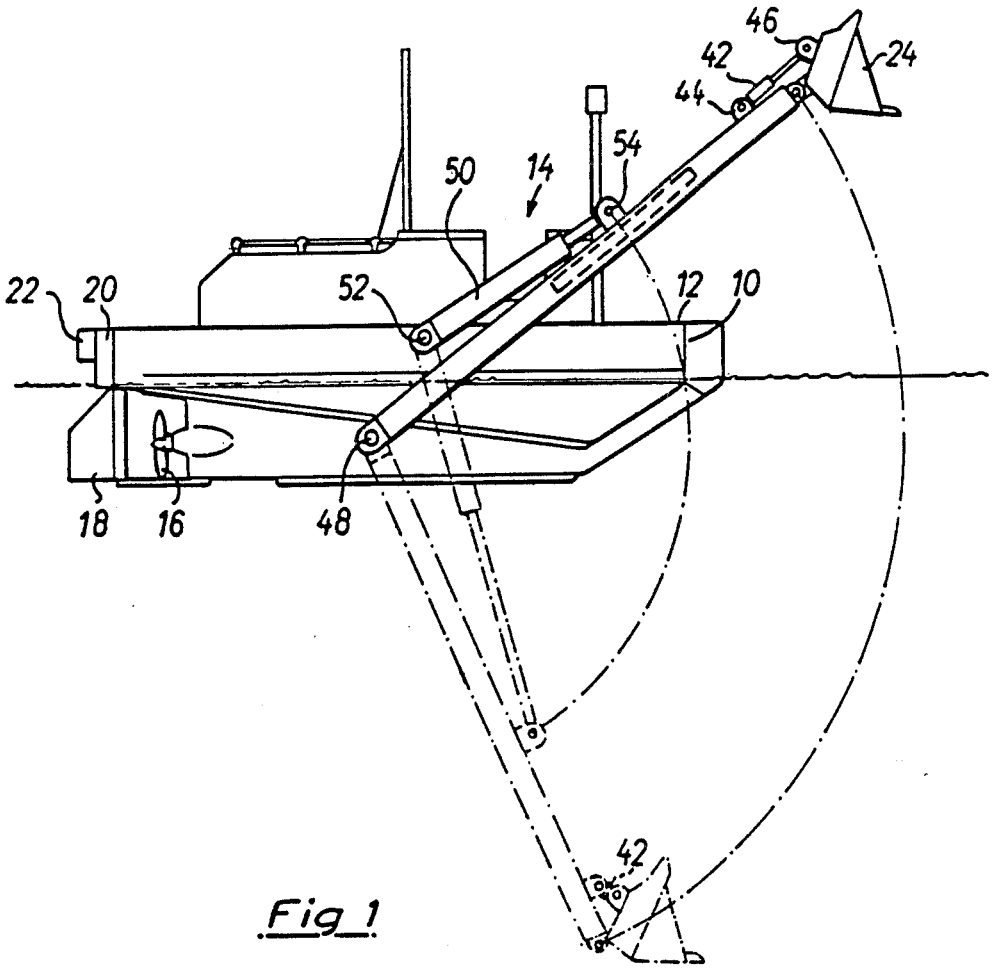
FIG. 1 is a side view of a first embodiment of water craft in accordance with the invention.
Figure 2:
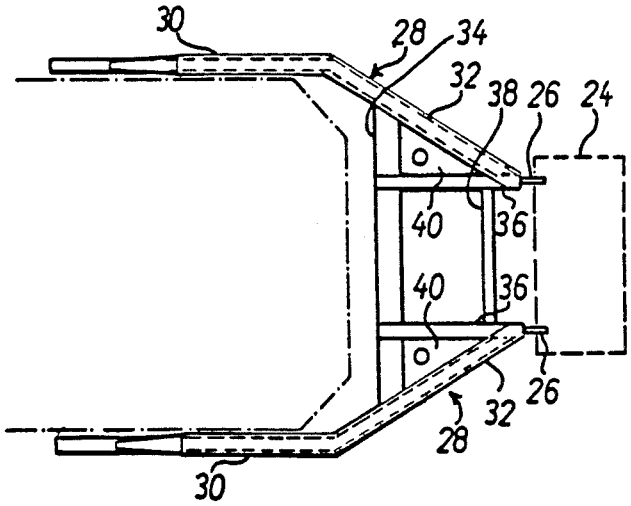
FIG. 2 is a plan view of a portion of the craft shown in FIG. 1.

Referring initially to FIGS. 1 and 2 of the drawings, the water craft comprises a hull 10 having a substantially flat deck portion 12, and a superstructure 14 which extends above the deck portion and in use houses an operator and the controls of the water craft. The craft may be propelled through the water by means of a propeller 16 driven by an inboard motor (not visible in the Figures), and may be steered by means of a rudder 18 situated behind the propeller.

As best seen in FIG. 1, the bottom of the hull is generally flat, whereas the lower side of the hull slants downwardly from the bow of the craft and slopes upwardly towards the stern of the craft. The lower sides of the hull also converge inwardly towards the stern and meet on the center line or beam of the craft, where the propeller 16 is situated.

The stern of the ship is provided with an additional buoyancy chamber 20 and ballast in the form of a 0.5 ton (550 kg) steel girder 22 is attached to the buoyancy portion 20. The ballast is to counterbalance the scoop, as will be explained hereinafter.

Mounted at the bow of the craft is a scoop 24 for removing debris from the bed of the waterway. The scoop is pivotally mounted at pivots 26 to each of two lifting arms 28. The lifting arms each comprise two portions, one of the portions 30 being parallel to the side of the craft, and the other of the portions 32 being inclined towards the centerline of the craft, such that the ends of the two arms 28 project towards one another as shown in FIG. 2. A main reinforcing beam 34 is connected between the two mutually inclined portions 32. Two reinforcing spars 36 extend between the free ends of the arms 28 and the reinforcing beam 34, and are interconnected by a further transverse reinforcing spar 38. Triangular metal plates 40 are connected between the beam 34, inclined portion 32 and spar 36, for added stiffness. A hydraulic ram 42 extends between lugs 44 and 46 on the spar 38 and scoop 24 respectively, by means of which the scoop is pivotable about the pivots 36.

The arms 28 are pivotally mounted approximately midships, for example, in the central third of the craft, on pivots 48 which are secured to either side of the hull 10, such that, with an empty scoop, the pivots 48 lie below the waterline. The arms 28 are pivotable by means of a hydraulic ram 50 which is pivotally mounted to the side of the hull 10 at pivot 52 and to a lug 54 situated towards the forward end of the portion 30 of each arm 28. Preferably as shown, two rams 50 are provided, one on each side of the craft, each ram acting on its respective arm 28. By retracting the ram, the arms 28 and the scoop 24 thereon are pivoted about pivots 48 to move the scoop into the uppermost position, illustrated in full lines in FIG. 1. By extending the rams 50, the arms 28 and the scoop 24 thereon are pivoted clockwise as viewed in FIG. 1, to a position such that the scoop lies well below the waterline (illustrated in dotted lines). When in its lowest position, the base of the scoop is some sixteen feet (4.88 m) below the surface of the water.

In use, the craft is propelled by propeller 16 along the waterway, with the scoop above the waterline, to that point on the waterway where it is desired to remove debris from the bed. The rams 50 are then extended, thereby pivoting the arms about the pivots 48, such that the scoop lies below the level of the water. In practice, the rams 50 are adjusted so that the scoop lies level, or slightly above, the level of the bed. As the craft is propelled forwards by the propeller 16, the rams 50 are then slightly extended so that the scoop 20 extends into the debris situated on the bed. The forward motion of the craft causes the craft to pick up the debris. It should be noted that in this position the ram 42 is fully retracted to allow the scoop to pick up the maximum amount of material. When the craft has moved forward a short distance and the scoop is full, the propeller 16 is stopped and the rams 50 are retracted, thereby pivoting the arms upwardly and withdrawing the scoop 24 above the water surface. The debris which has been picked up in the scoop 24 may then be discharged either onto land or into a suitably positioned floating receiver, such as a barge, by extending the small ram 42 to pivot the scoop 24 downwardly about the pivot 26. By extending the rams 50 and repeating this procedure, the bed of the waterway may be quickly and conveniently cleared of debris.

It may be appreciated that a full scoop 24 has a considerable weight, and the steel girder 22 which acts as a ballast helps to keep the craft level when the scoop is full, and reduces the tendency for it to tip forwards. Moreover, since the arms 28 are pivoted below the waterline this produces an added stability to the craft since the pivots 48 are positioned below the center of gravity of the craft. Moreover, since the arms are pivoted approximately midships (i.e., near the center of gravity) this adds a further element of stability to the craft.

Figure 3:
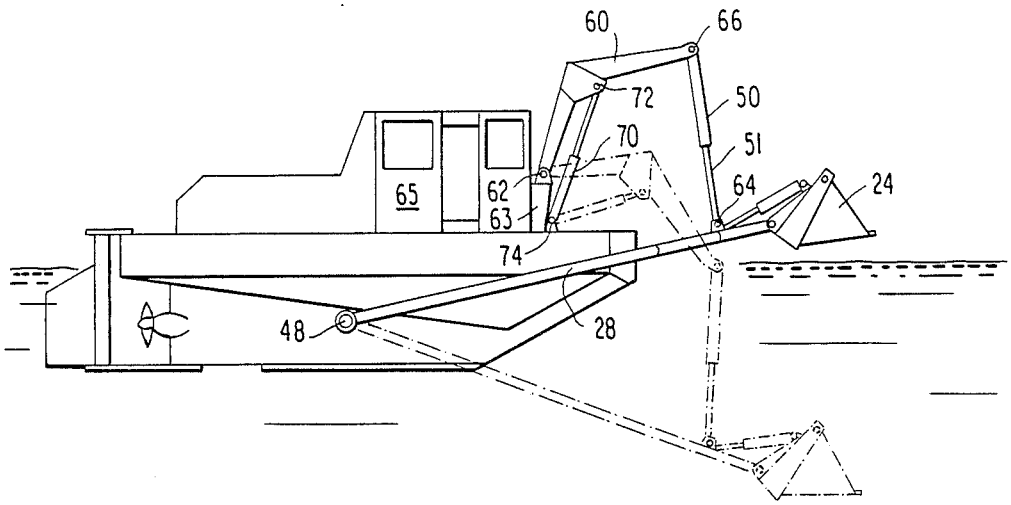
FIGS. 3 and 4 are views similar to FIGS. 1 and 2, respectively, but of a preferred embodiment of the invention.
Figure 4:
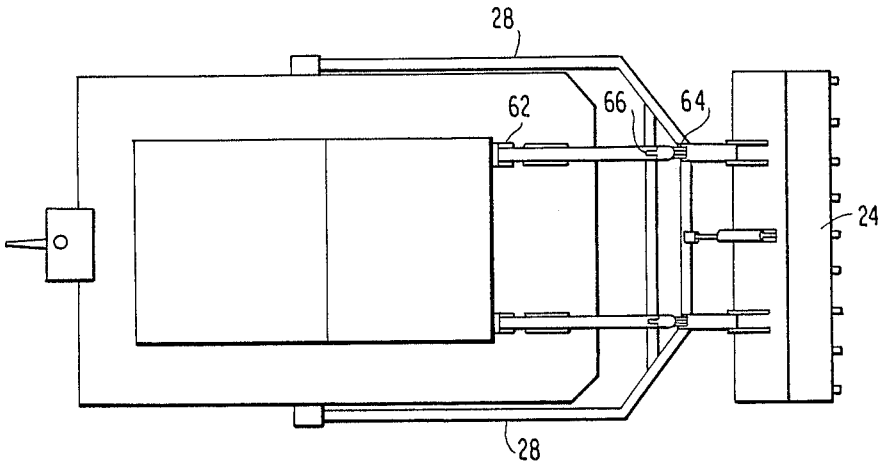

Referring now to FIGS. 3 and 4, there is illustrated another embodiment of the invention wherein the rams 50 rather than being pivotally mounted to the hull of the craft as shown in the embodiment of FIGS. 1 and 2, is mounted to the end of an inverted L-shaped boom 60 at pivot 66. Boom 60 is pivotally mounted at its lower end by pivot 62 to a pedestal 63 raised from the deck of the hull in front of a cabin 65. Boom 60 is raised and lowered by a hydraulic ram 70 whose movable rod 72 is pivoted at 72 to an intermediate portion of the boom 60. The opposite end of ram 70 is pivotally mounted at 74 to the hull at the deck. The movable rod 51 of ram 50 is pivotally connected to the arm 28 at 64.

As indicated by the dotted lines in FIG. 3, retraction of ram rod 70 will serve to lower the arm 28 and scoop 24 below the base of the craft for engaging debris along the water bed. Extension of ram rod 70 will, of course, serve to raise the scoop 24. In the embodiment of FIGS. 3 and 4, the position of the arm 28 and scoop 24 may further be adjusted by extension or retraction of rod 51 of ram 50. The position of the pivotal mounting 88 of arm 28 in the FIG. 3 embodiment is the same as that of the FIG. 1 embodiment.

In the preferred embodiment as shown in FIG. 4, there are two booms 60 and two rams 70 respectively associated with the two rams 50 which operate on the two lifting arms 28.

What is claimed is:

1. A water craft for clearing debris from the beds of navigational waters, the water craft comprising a floatable body having a bow and stern, propulsion means and steering means, at least one lifting arm having a scoop mounted on the arm, said lifting arm being pivotally mounted on the floatable body at a pivot mounted at one side in a center third of the craft and below the waterline when the scoop is empty, said lifting arm having a length such that the scoop is located beyond the bow and is movable by the arm to a position substantially below the craft to scoop debris from the beds of waters, and actuating means for pivoting the arm downwardly to lower the scoop to a position below the level of the base of the floatable body, whereupon the movement of the water craft induced by the propulsion means and guided by the steering means, causes the scoop to pick up debris, the arm also being pivotable upwardly by the actuating means to raise the scoop above the surface of the water for discharging the debris removed from the waterway, and ballast means on the craft at the stern thereof for counterbalancing the scoop.

2. A water craft as claimed in claim 1, wherein the scoop is mounted adjacent to the free end of the arm.

3. A water craft as claimed in claim 1 or claim 2, wherein the scoop is pivotally mounted on the arm.

4. A water craft as claimed in claim 3, comprising further actuating means for pivoting the scoop relative to the arm.

5. A water craft as claimed in claim 1 comprising two lifting arms mounted on opposite sides of the craft.

6. A water craft as claimed in claim 1 wherein said actuating means includes a fluid actuator having one end pivotally mounted to one side of the body and an opposite end connected to the lifting arm.

7. A water craft as claimed in claim 1 wherein said actuating means includes a boom mounted on a forward portion of the body and a fluid actuator connected to and between the boom and the lifting arm.

8. The water craft defined in claim 7 wherein said actuating means includes an actuator for raising and lowering the boom.

9. The water craft defined in claim 1 wherein said pivot of the lifting arm is located approximately midships of the craft.

10. The water craft defined in claim 9 wherein said pivot of the lifting arm is located near the center of gravity of the craft.

11. A water craft for clearing debris from the beds of navigational waters, the water craft comprising a floatable body having a bow and propulsion means and steering means, at least one lifting arm pivotally mounted on a side of the floatable body, a scoop mounted on the arm, said lifting arm having a length such that the scoop is located beyond the bow and is movable by the arm to a position substantially below the craft to scoop debris from the beds of waters, and actuating means for pivoting the arm, said actuating means including a boom pivotally mounted on the body and extending over the bow, a fluid actuator having one end pivotally mounted on the body and an opposite end pivotally connected to the boom to raise and lower the boom, and a fluid actuator pivotally connected between the boom and the arm for raising and lowering the arm upon raising and lowering the boom and for moving the arm relative to the boom, the arm being pivotally downwardly to lower the scoop to a position below the level of the base of the floatable body, whereupon the movement of the water craft, induced by the propulsion means and guided by the steering means, causes the scoop to pick up debris, the arm also being pivotable upwardly to raise the scoop above the surface of the water for discharging the debris removed from the waterway.

12. The water craft defined in claim 11 further including an actuator for pivoting the scoop relative to the arm.

13. The water craft defined in claim 12 wherein the arm is pivoted to the body at a center third of the water craft.

14. The water craft defined in claim 13 further including ballast means situated on an end of the water craft opposite the scoop to balance the craft when the scoop carries debris.

15. The water craft defined in claim 13 wherein said pivot of the lifting arm is located approximately midships of the craft.

16. The water craft defined in claim 15 wherein said pivot of the lifting arm is located near the center of gravity of the craft.

* * * * *